US009974376B1

(12) United States Patent
Liu

(10) Patent No.: US 9,974,376 B1
(45) Date of Patent: May 22, 2018

(54) COSMETIC CONTAINER WITH LIGHT

(71) Applicant: Li-Mei Liu, New Taipei (TW)

(72) Inventor: Li-Mei Liu, New Taipei (TW)

(73) Assignee: Zhuhai Ding Rong Plastic Products Co., LTD, Zhuhai, Guangdong Province (CN)

( * ) Notice: Subject to any disclaimer, the term of this patent is extended or adjusted under 35 U.S.C. 154(b) by 0 days. days.

(21) Appl. No.: 15/415,954

(22) Filed: Jan. 26, 2017

(51) Int. Cl.
*A45D 40/18* (2006.01)
*A45D 40/26* (2006.01)

(52) U.S. Cl.
CPC ..... *A45D 40/18* (2013.01); *A45D 40/265* (2013.01)

(58) Field of Classification Search
CPC ..... A45D 40/18
See application file for complete search history.

(56) References Cited

U.S. PATENT DOCUMENTS 7,758,267 B1 * 7/2010 Zhang ..... A45D 40/18 401/52
9,101,193 B1 * 8/2015 Liu ..... A45D 40/00

* cited by examiner

*Primary Examiner* — David Walczak
*Assistant Examiner* — Joshua Wiljanen

(57) ABSTRACT

A cosmetic container is provided with a case; a cosmetic member partially disposed in the case; and a light assembly received in the case. The case includes an opening and a glass adjacent to the opening. The cosmetic member includes a carrier, a mount, and a base secured to the mount. The carrier passes through the mount to have a rear end secured to the base. The light assembly includes a power source, a switch, and an exposed lighting unit. An actuator is disposed on a first seat and may activate the switch. A second seat is disposed on the first seat. A transmitting member includes an opening member and a rib on the actuator. A transparent member is disposed on the opening member.

10 Claims, 6 Drawing Sheets

COSMETIC CONTAINER WITH LIGHT

BACKGROUND OF THE INVENTION

1. Field of the Invention

The invention relates to cosmetic containers and more particularly to a cosmetic container having a light which can be turned on by pressing a transparent member.

2. Description of Related Art

A conventional cosmetic container is shown in FIG. 6 and comprises a case 50, a light assembly 60 and a cosmetic member 70. The parallelepiped case 50 includes an interior space 501 for accommodating the light assembly 60, a rectangular hinged cover 52, ad a window 54 enclosed in the cover 52. The light assembly 60 includes a compartment member 62, a hollow cylinder 64 for receiving a projecting cosmetic element of the cosmetic member 70, a plurality of cells 66 received in the compartment member 62, a lighting unit 68 mounted on the compartment member 62, and an activation switch 69 mounted to the compartment member 62, the activation switch 69 having an actuator 691 extending out of the compartment member 62, and a torsion spring 692.

In response to clockwise pivoting the cover 52 to close the case 50, the actuator 691 is depressed to compress the torsion spring 692. As a result, the circuit interconnecting the cells 66 and the lighting unit 68 is opened (i.e., off). To the contrary, in response to counterclockwise pivoting the cover 52 to open the case 50, the actuator 691 rises due to the expansion of the torsion spring 692. As a result, the circuit interconnecting the cells 66 and the lighting unit 68 is completed (i.e., on).

However, an accidental opening of the cover 52 can turn on the lighting unit 68 even when the environment is sufficiently illuminated. In fact, a user may use the window 54 to make up without the illumination of the lighting unit 68. Therefore, the lit lighting unit 68 can undesirably consume energy of the cells 66.

Thus, the need for improvement still exists.

SUMMARY OF THE INVENTION

It is therefore one object of the invention to provide a cosmetic container comprising a case; a cosmetic member; and a light assembly; wherein the case includes an interior space open to a first end for accommodating the light assembly, a first opening on one surface, and a glass on the same surface as the first opening and adjacent to the first opening; wherein the cosmetic member is partially disposed in the case and includes a carrier, a mount, and a base; wherein the mount is secured to the base, and the carrier passes through the mount to have a rear end secured to the base; wherein the light assembly includes at least one lighting unit, a power source, and an activation switch for activating the at least one lighting unit by interconnecting the power source and the at least one lighting unit, and deactivating the at least one lighting unit by disconnecting the power source from the at least one lighting unit; wherein both the activation switch and the power source are disposed on a first seat which has a receptacle for receiving a portion of the at least one lighting unit with the remaining portion of the at least one lighting unit exposed on the first seat; wherein an actuator is disposed on the first seat and configured to activate the activation switch; wherein a second seat is disposed on the first seat and includes a second opening with the exposed portion of the at least one lighting unit disposed therein; wherein a transmitting member is disposed in the second opening and includes a third opening with the exposed portion of the at least one lighting unit disposed therein, and a rib on the actuator; and wherein a transparent member is disposed on the third opening and under the first opening.

Preferably, the first opening, the second opening, and the third opening are aligned with one another.

Preferably, the case further comprises a plurality of grooves on the first end, and the mount further comprises a plurality of ridges on an outer surface, the ridges being complimentarily disposed in the grooves.

Preferably, the base of the cosmetic member includes a gripping member on an outer surface, and wherein the mount is releasably secured to the gripping member.

Preferably, light emitted by the at least one lighting unit is directional so that the emitted light is configured to orient toward the lips of an individual using the cosmetic container.

Preferably, further comprises a weight disposed in the base of the cosmetic member.

Preferably, a rear end of the carrier is fastened by the base of the cosmetic member.

Preferably, the base of the cosmetic member includes a plurality of snapping members on an inner surface, and wherein a rear end of the carrier is fastened by the snapping members of the base of the cosmetic member.

Preferably, each of the at least one lighting unit is a light-emitting diode (LED).

Preferably, further comprises a cosmetic element partially disposed in the carrier, and wherein the cosmetic element is one of lipstick, lip balm, concealer, blemish cover cream, and eyebrow mascara.

The invention has the following advantages and benefits in comparison with the conventional art:

A depressing of the transparent member can turn on the light and a subsequent depressing of the transparent member can turn off the light. Its use is easy and simple. It can save energy when the light of the environmental is sufficient. The transparent member is in the first opening not flush with the outer surface of the case. Thus, the chance of accidentally pressing the transparent member is decreased to a minimum. An individual may press the transparent member to make up when the environment is dark.

The first opening, the second opening, and the third opening are aligned with one another and are disposed directly over the light. Thus, emitted light can be directed out of the case with a minimum loss of illumination. The emitted light is directional so that the emitted light can be oriented toward the lips of an individual using the cosmetic container rather than the eyes to cause hurt. The lighting unit is implemented as LED which has the benefits of low energy consumption, reliable and durable.

The cosmetic member includes a carrier, a mount, and a base having a gripping member on an outer surface for enhancing the fastening of the base and the mount. Thus, soldering is not required and this can greatly decrease the manufacturing cost.

The weight is disposed in the base. Thus, an individual holding the base of the cosmetic member can feel a degree of comfort.

The cosmetic element partially disposed in the carrier can be replaced with another one of different color.

The above and other objects, features and advantages of the invention will become apparent from the following detailed description taken with the accompanying drawings.

DETAILED DESCRIPTION OF THE INVENTION

Figure 1:
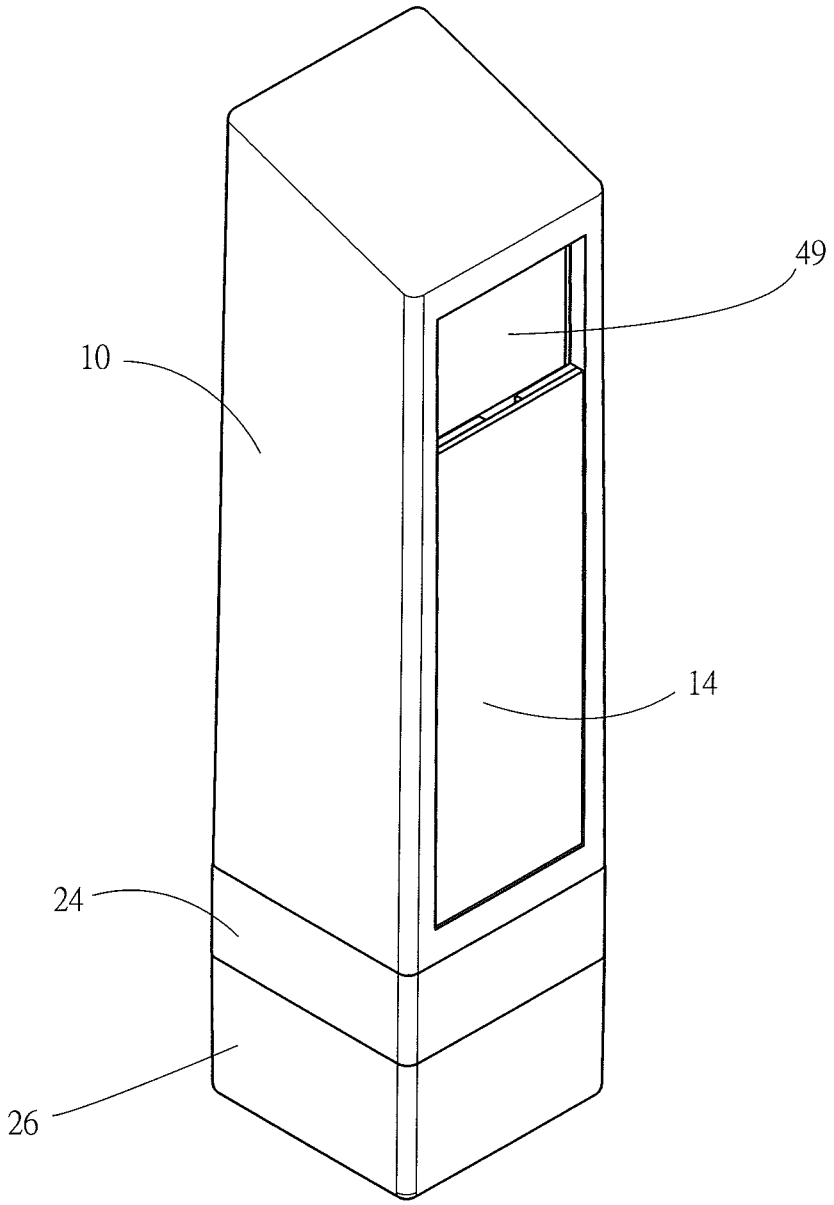
FIG. 1 is a perspective view of a cosmetic container with light according to the invention.

Referring to FIGS. 1 to 5, a cosmetic container with light in accordance with the invention comprises a case 10, a cosmetic member 20, and a light assembly 30. The case 10 includes an interior space 101 open to a rectangular end for accommodating the light assembly 30, and a first opening 102 on one surface thereof, a glass 14 on the same surface as the first opening 102 and adjacent to the first opening 102, and four spaced grooves 103 on four edges of the rectangular end respectively.

The cosmetic member 20 includes a cylindrical carrier 22, a mount 24, and a base 26. The base 26 includes a gripping member 261 on an outer surface and a plurality of snapping members 262 on an inner surface. A weight 25 is provided in the base 26. The mount 24 is releasably secured to the gripping member 261 (i.e., the base 26). The mount 24 includes a front recess 241 for securely receiving a portion of the carrier 22. The rear end of the carrier 22 is fastened by the snapping members 262. The mount 24 further comprises four spaced ridges 242 on an outer surface respectively. The ridges 242 are complimentarily disposed in the grooves 103 to secure the mount 24 and the case 10 together.

The light assembly 30 includes a lighting unit (e.g., light-emitting diode (LED)) 34, two cells 36, and an activation switch 32 for electrically connecting the cells 36 to the lighting unit 34. The activation switch 32 and the cells 36 are mounted in a first seat 42, which has a receptacle 421 for receiving a portion of the lighting unit 34, i.e., the lighting unit 34 being exposed on the first seat 42. An actuator 44 is provided on the first seat 42 and is adapted to activate the activation switch 32. A second seat 46 is placed on the first seat 42 and includes a second opening 461 with the exposed portion of the lighting unit 34 disposed therein. A transmitting member 48 is provided in the second opening 461 and includes a third opening 481 with the exposed portion of the lighting unit 34 disposed therein. The transmitting member 48 further comprises a rib 482 on the actuator 44. The first, second and third openings 102, 461, and 481 are aligned with one another. A transparent member 49 is provided on the third opening 481 and under the mouth of the first opening 102, and the transparent member 49 abuts against the rib 482. A cosmetic element (e.g., lipstick, lip balm, concealer, blemish cover cream, and eyebrow mascara) 18 is partially provided in the carrier 22.

Figure 2:
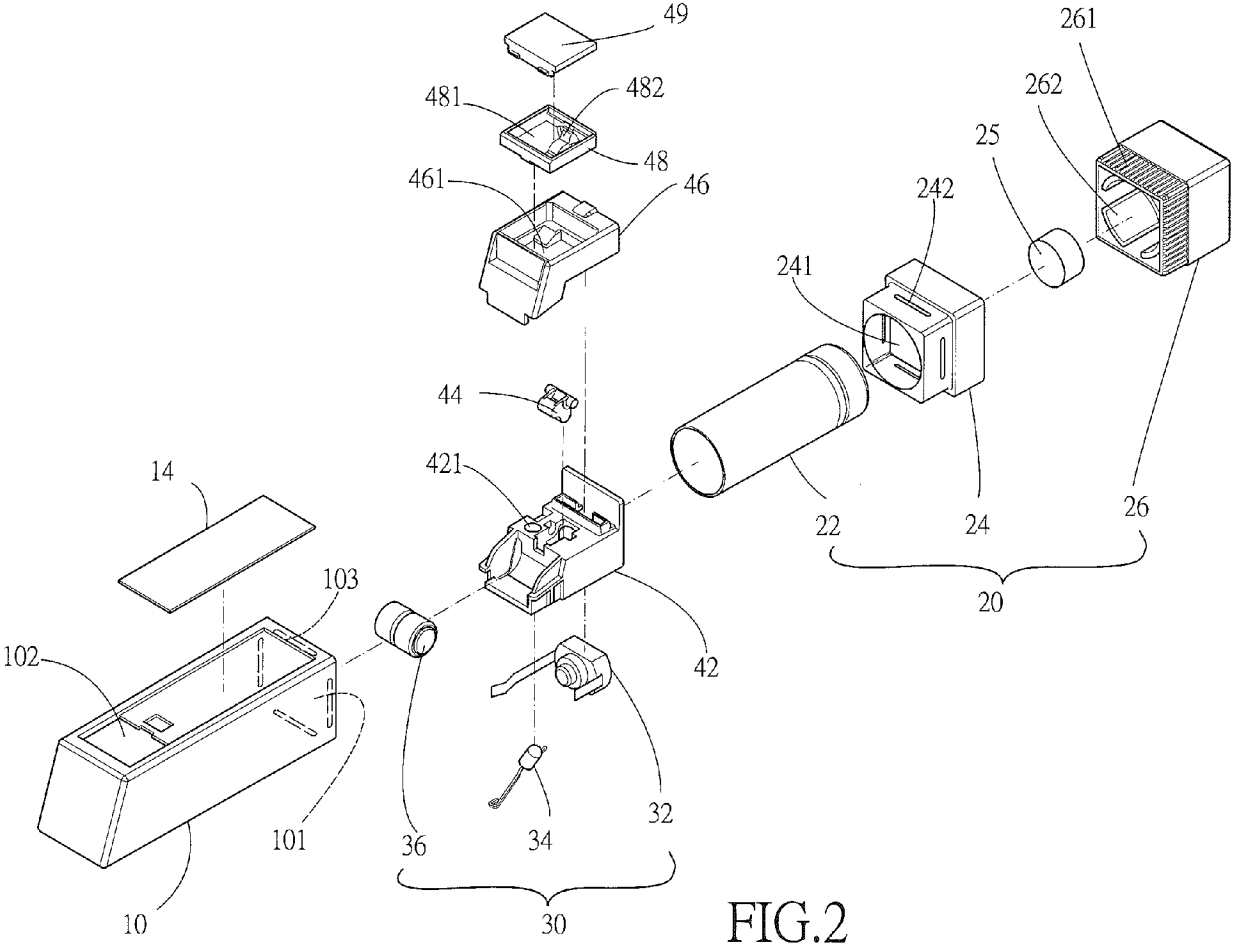
FIG. 2 is an exploded view of the cosmetic container.
Figure 3:
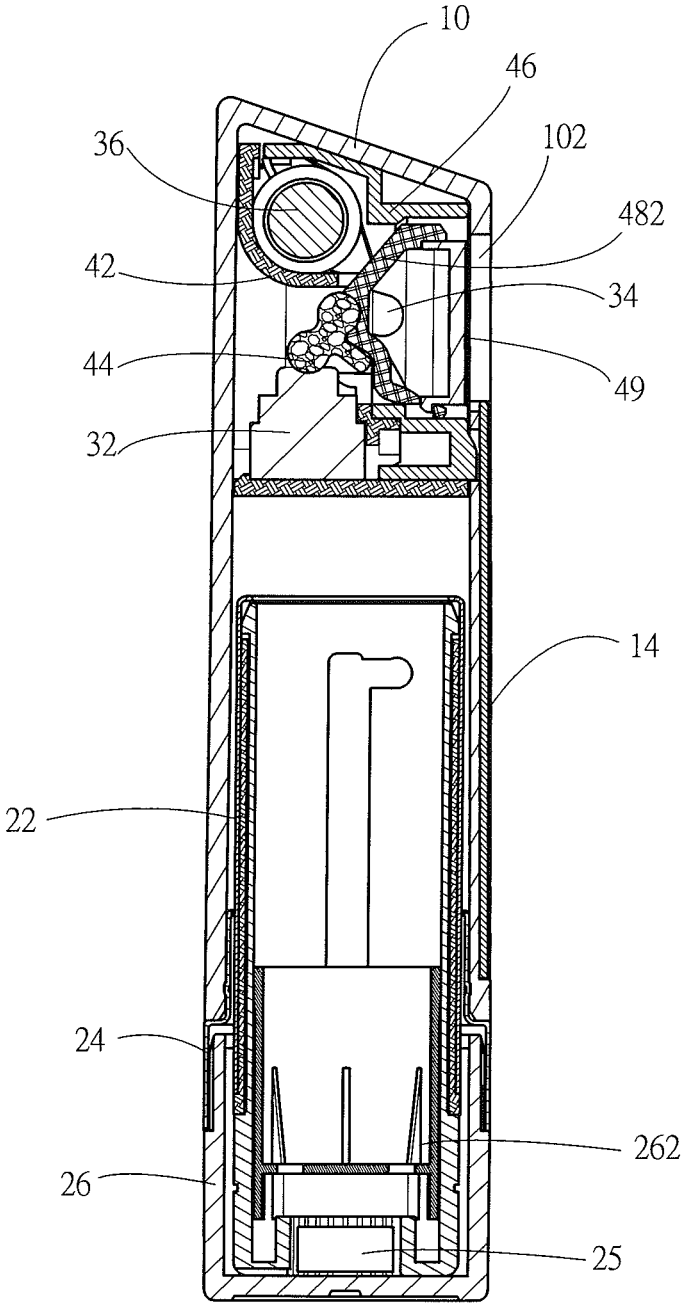
FIG. 3 is a longitudinal sectional view of the cosmetic container.
Figure 4:
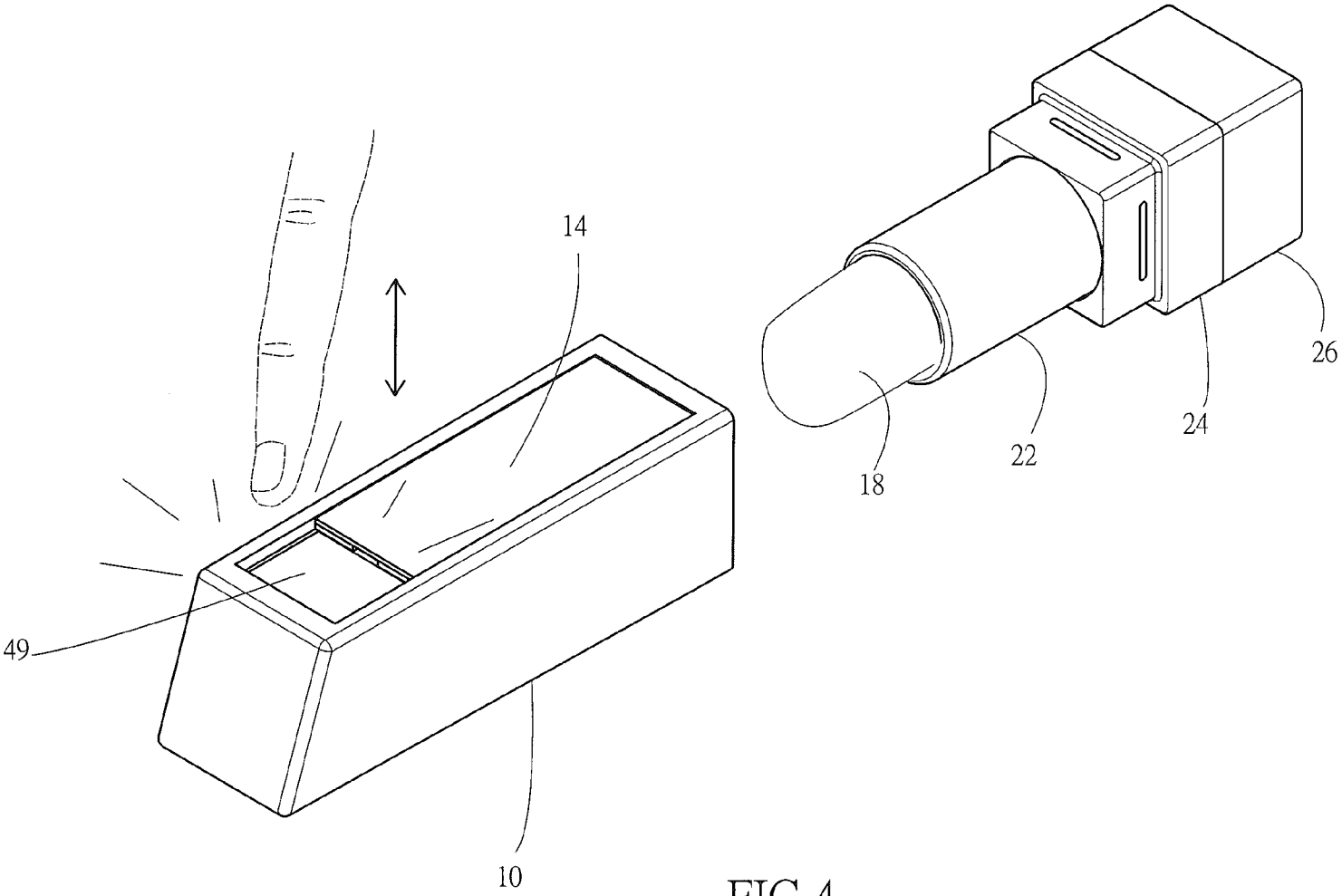
FIG. 4 is a perspective view showing the disengaged, lit case and the cosmetic member.
Figure 5:
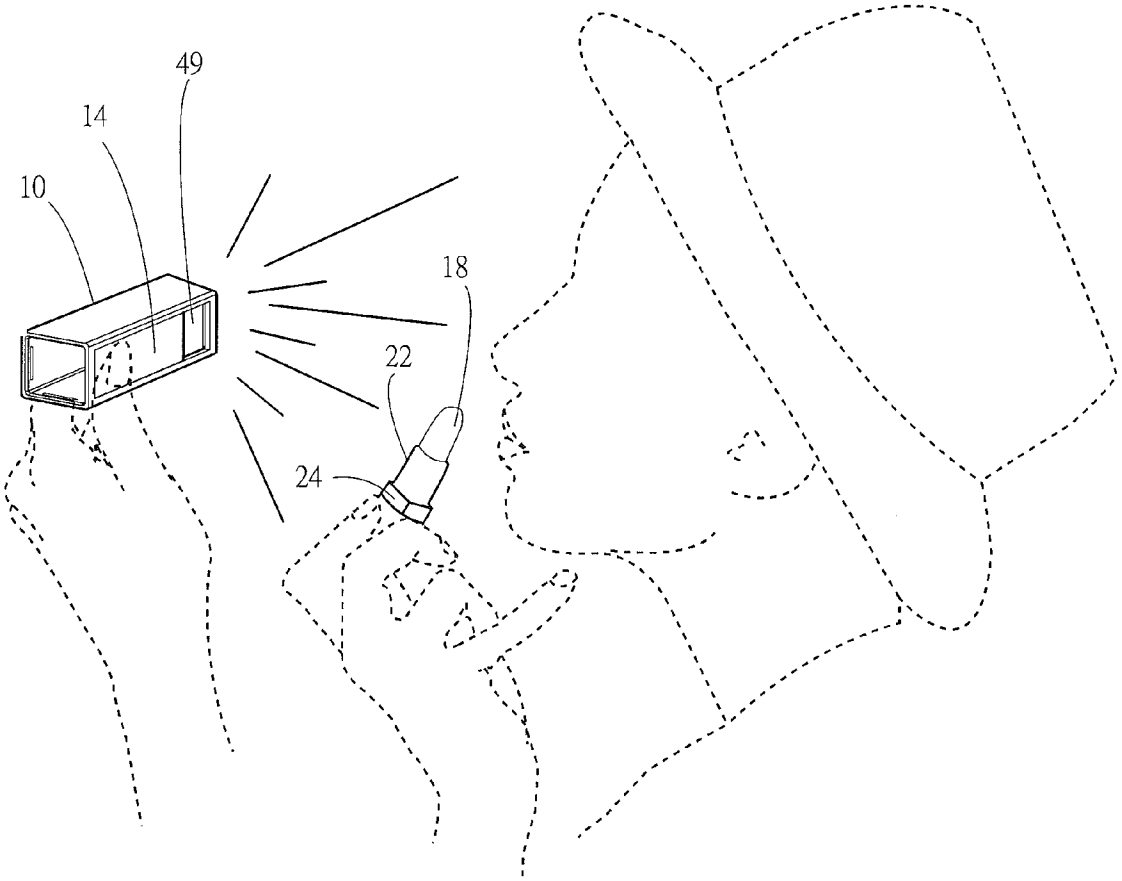
FIG. 5 is an environmental view showing the lit case in use.
Figure 6:
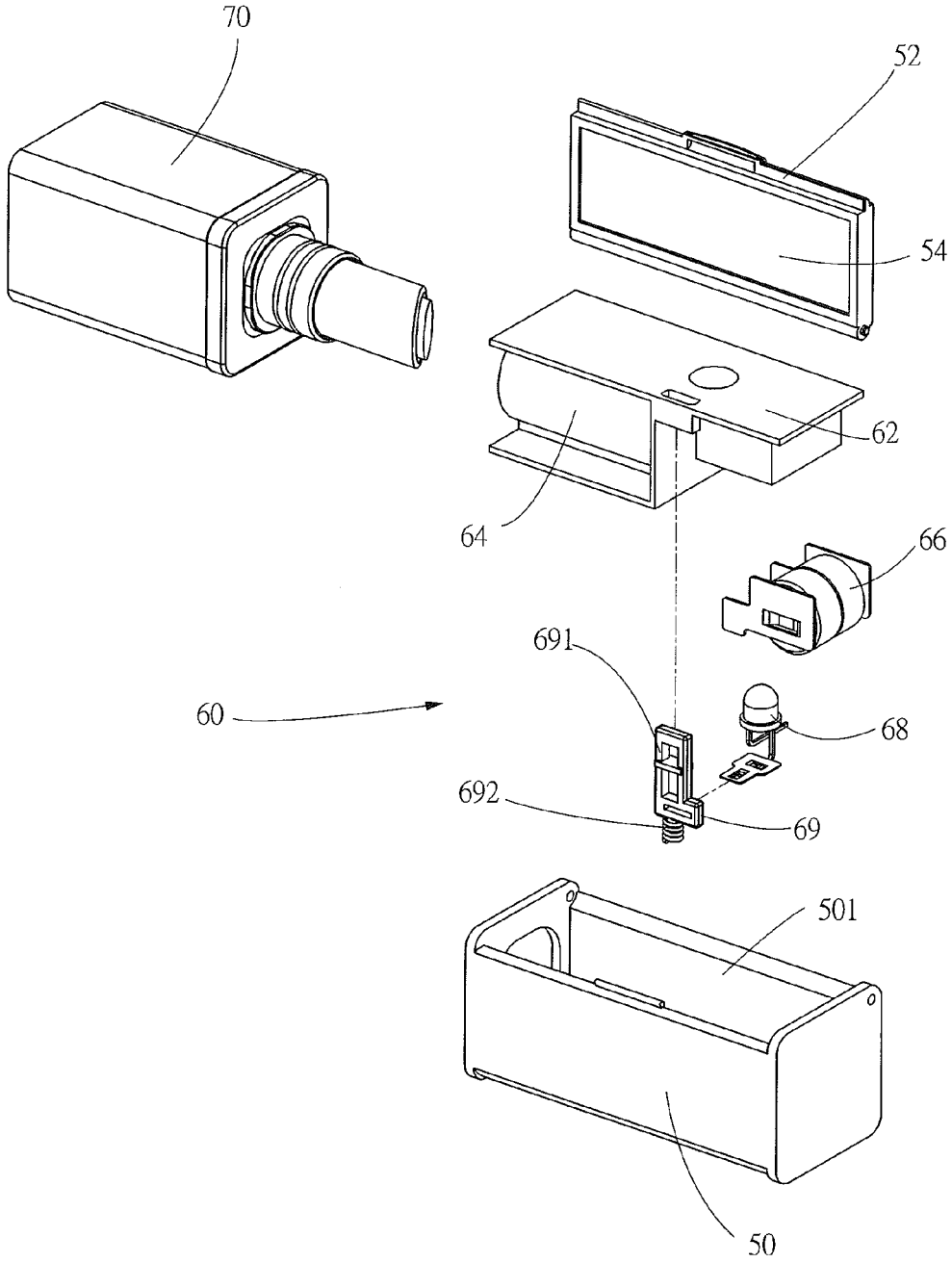
PRIOR ART FIG.6
FIG. 6 is an exploded view of a conventional cosmetic container with light.

Referring to FIGS. 2, 3 and 5 specifically, an individual may press the transparent member 49 to depress the transmitting member 48. And in turn, the rib 482 presses the actuator 44 to conduct the activation switch 32. As such, the circuit interconnecting the cells 36 and the lighting unit 34 is completed (i.e., on). As a result, light is illuminated from the lighting unit 34 to penetrate the transparent member 49 via the first, second and third openings 461, 481 and 102. It is noted that light emitted by the lighting unit 34 is directional. The individual may easily orient the emitted light toward the cosmetic element 18 in front of the lips rather than the eyes. Therefore, a makeup can be done.

While the invention has been described in terms of preferred embodiments, those skilled in the art will recognize that the invention can be practiced with modifications within the spirit and scope of the appended claims.

What is claimed is:

1. A cosmetic container comprising:

a case;

a cosmetic member; and a light assembly;

wherein the case includes an interior space open to a first end for accommodating the light assembly, a first opening on one surface, and a glass on the same surface as the first opening and adjacent to the first opening;

wherein the cosmetic member is partially disposed in the case and includes a carrier, a mount, and a base;

wherein the mount is secured to the base, and the carrier passes through the mount to have a rear end secured to the base;

wherein the light assembly includes at least one lighting unit, a power source, and an activation switch for activating the at least one lighting unit by interconnecting the power source and the at least one lighting unit, and deactivating the at least one lighting unit by disconnecting the power source from the at least one lighting unit;

wherein both the activation switch and the power source are disposed on a first seat which has a receptacle for receiving a portion of the at least one lighting unit with the remaining portion of the at least one lighting unit exposed on the first seat;

wherein an actuator is disposed on the first seat and configured to activate the activation switch;

wherein a second seat is disposed on the first seat and includes a second opening with the exposed portion of the at least one lighting unit disposed therein;

wherein a transmitting member is disposed in the second opening and includes a third opening with the exposed portion of the at least one lighting unit disposed therein, and a rib on the actuator; and wherein a transparent member is disposed on the third opening and under the first opening, and the transparent member abuts against the rib.

2. The cosmetic container of claim 1, wherein the first opening, the second opening, and the third opening are aligned with one another.

3. The cosmetic container of claim 1, wherein the case further comprises a plurality of grooves on the first end, and the mount further comprises a plurality of ridges on an outer surface, the ridges being complementarily disposed in the grooves.

4. The cosmetic container of claim 1, wherein the base of the cosmetic member includes a gripping member on an outer surface, and wherein the mount is releasably secured to the gripping member.

5. The cosmetic container of claim 1, wherein light emitted by the at least one lighting unit is directional so that the emitted light is configured to orient toward the lips of an individual using the cosmetic container.

6. The cosmetic container of claim 1, further comprising a weight disposed in the base of the cosmetic member.

7. The cosmetic container of claim 1, wherein a rear end of the carrier is fastened by the base of the cosmetic member.

8. The cosmetic container of claim 1, wherein the base of the cosmetic member includes a plurality of snapping members on an inner surface, and wherein a rear end of the carrier is fastened by the snapping members of the base of the cosmetic member.

9. The cosmetic container of claim 1, wherein each of the at least one lighting unit is a light-emitting diode (LED).

10. The cosmetic container of claim 1, further comprising a cosmetic element partially disposed in the carrier, and wherein the cosmetic element is one of lipstick, lip balm, concealer, blemish cover cream, and eyebrow mascara.

* * * * *